US007490798B2

(12) United States Patent
Mann

(10) Patent No.: US 7,490,798 B2
(45) Date of Patent: Feb. 17, 2009

(54) APPARATUS FOR SUPPORTING A CONTAINER

(76) Inventor: David Alexander Mann, 307-1010 St. Andrews Street, New Westminster, BC (CA) V3M 1W3

( * ) Notice: Subject to any disclaimer, the term of this patent is extended or adjusted under 35 U.S.C. 154(b) by 209 days.

(21) Appl. No.: 11/473,492

(22) Filed: Jun. 22, 2006

(65) Prior Publication Data

US 2007/0295685 A1 Dec. 27, 2007

(51) Int. Cl.
*A45D 19/04* (2006.01)

(52) U.S. Cl. ..... 248/175; 248/176.3; 248/311.2; 141/319

(58) Field of Classification Search ..... 414/403, 414/419; 222/166; 211/77, 81, 85, 85.25, 211/85.31; 248/175, 311.3, 136, 133; 141/319, 141/337, 363, 364, 365, 366
See application file for complete search history.

(56) References Cited

U.S. PATENT DOCUMENTS 1,359,026 A * 11/1920 Briggs ..... 248/27.8
2,211,227 A * 8/1940 Feindel ..... 248/106
2,648,513 A * 8/1953 Groff ..... 248/107
2,789,591 A * 4/1957 Benz ..... 141/233
2,940,705 A * 6/1960 Lotz ..... 248/27.8
3,286,849 A 11/1966 Dominos
3,615,150 A * 10/1971 Indrunas ..... 141/375
D233,723 S * 11/1974 Guitierrez ..... D7/704
4,217,941 A 8/1980 Catalano
4,271,878 A 6/1981 Bologa
4,454,897 A 6/1984 Valiant
4,496,124 A 1/1985 Cole
D290,673 S * 7/1987 Imatt ..... D7/619.1
4,678,149 A 7/1987 Chase
4,790,708 A 12/1988 Von Bennigsen-Mackiewicz et al.
5,002,246 A * 3/1991 Chaffin et al. ..... 248/153
D321,963 S * 11/1991 Welder ..... D32/58
5,080,150 A 1/1992 Deadwyler, Jr.
5,146,957 A 9/1992 Belokin, Jr. et al.
5,197,612 A 3/1993 Thomson
5,297,600 A 3/1994 Downes et al.
5,560,406 A 10/1996 Fineroff et al.
5,794,671 A 8/1998 Smith
5,794,904 A 8/1998 Hackley
5,853,154 A 12/1998 Ashley
5,950,698 A 9/1999 Cristea et al.
6,109,581 A 8/2000 Kracke et al.

(Continued)

FOREIGN PATENT DOCUMENTS

GB 2335353 A 9/1999

*Primary Examiner*—J. Allen Shriver, II
*Assistant Examiner*—Bradley H Duckworth

(57) ABSTRACT

A collapsible apparatus for supporting a container at an adjustable angle of incline to drain its contents includes a base, a shoulder support attached to the base for supporting a shoulder of the container, and a body support for supporting the container body above the shoulder.

The shoulder support includes a pair of legs hingedly attached to the base at spaced apart hinge ends and joined at its opposite ends supported by a strut hingedly connected to the base, and spaced apart crosspieces between the legs to act as a shoulder stop. The body support includes a pair of arms hingedly attached to the base at spaced apart arm hinge ends and slidably attached to a body support member which is removably attachable at its ends to the shoulder support. The angle of incline is adjusted by slidably adjusting the distance between the arms.

6 Claims, 5 Drawing Sheets

U.S. PATENT DOCUMENTS 6,213,352 B1 * 4/2001 Boyer, Jr. ..... 222/166
6,296,024 B1 10/2001 Oestreich
6,322,026 B1 * 11/2001 Ju ..... 248/175
6,345,723 B1 2/2002 Blake et al.
6,684,922 B1 2/2004 Alston et al.
2004/0200937 A1 10/2004 Scannell
2007/0210109 A1 * 9/2007 Wiemholt ..... 222/166

* cited by examiner

APPARATUS FOR SUPPORTING A CONTAINER

BACKGROUND OF THE INVENTION

1. Field of Invention

This invention relates to mechanical support for objects and, in particular, to an apparatus and method for supporting a container.

2. Description of Related Art

Many situations arise in which it is desirable to support an object at a position or angle of incline different from the natural position of the object, which natural position is typically an upright or other freestanding and stable position. In the case of a container for dispensing a liquid or viscous fluid, such as condiment bottles, condiment tubes and oil containers for example, it is often desirable to position the container at an angle of incline for draining the contents of the container in a manner that is stable, adjustable and will not mark, scar or otherwise damage the container.

Several schemes for draining a container have been devised. However, many such schemes use expensive materials or are complex to manufacture. Many such schemes do not provide adjustability of the angle of incline. Some schemes involve clamping or gripping of the container, which can mark, scar or otherwise damage the container, is not suitable for fragile containers, and is not convenient for malleable containers which deform when attempts are made to grip or clamp them. Many such schemes support only one part of the container with the effect of reducing stability, which increases the likelihood of the container falling or being knocked over and damaged.

Many such schemes expose the outer surface of the container at its dispensing end to contents drained from the container with the effect of contaminating the drained contents by any material or substances on the container's outside. Furthermore, dispensed contents may remain on the container's outside and drip when the container is separated from the drained contents, necessitating the inconvenience of cleaning the drips and/or the container's outer surface. In the case of food containers, contamination of the drained contents is unsanitary and can render the drained contents unsuitable for human consumption.

Many schemes for draining a container involve the use of bulky devices and devices which are not collapsible for convenient storage.

SUMMARY

The various shortcomings noted above may be addressed by providing, in accordance with one aspect of the invention, an apparatus for supporting a container. The apparatus includes: a base; a shoulder support attached to said base for supporting a shoulder of the container a first distance from said base; and a body support attached to said base for supporting a body of the container a second distance from said base greater than said first distance, whereby said body support is positionable at more than one position relative to said shoulder support.

The apparatus may be collapsible to a generally planar collapsed configuration.

The apparatus may be operable to support the container at an adjustable angle of incline.

The shoulder support may include first and second legs attached to the base at respective and spaced apart first and second leg attachment ends of the first and second legs. The shoulder support may include a shoulder stop dimensioned to prevent the body from passing the shoulder stop. The shoulder stop may include first and second spaced apart and generally parallel crosspieces extending between the first and second legs, respectively. The first and second legs may be joined at joined ends opposite the first and second leg attachment ends. The first and second legs may be hingedly attached at the first and second leg attachment ends to the base. The shoulder support may include a strut hingedly attached to the base at a strut attachment end of the strut. The strut may be removably attachable at an opposite strut end to the first and second legs at the joined ends. The apparatus may be configurable in an operational configuration, in which the strut is attached to the first and second legs, and in a collapsed configuration, in which the strut, the first and second legs and the base are substantially coplanar. The body support may include first and second arms attached to the base at respective and spaced apart first and second arm attachment ends. The body support may include a body support member removably attachable at support member ends of the body support member to the shoulder support. The first and second arms may be slidably attached at respective sliding ends opposite the first and second arm attachment ends to the body support member between the support member ends. The body support member may be rotatably attached to the first and second arms. The first and second arms may be hingedly attached to the base. In the collapsed configuration, the body support member, the first and second arms and the base may be substantially coplanar. The second distance may be adjusted when the distance between the respective sliding ends is slidably adjusted. The base may include a frame. The frame may have a generally triangular outer perimeter.

In accordance with another aspect of the invention, there is provided a method of supporting a container. The method involves supporting a shoulder of the container a first distance from a base by a shoulder support attached to the base; and supporting a body of the container a second distance from the base greater than the first distance by a body support attached to the base and positioned at one of multiple possible positions relative to the shoulder support. The method may further involve adjusting an angle of incline at which the container is supported.

In accordance with another aspect of the invention, there is provided an apparatus for supporting a container, which includes base means; shoulder support means for supporting a shoulder of the container a first distance from the base means; and body support means for supporting a body of the container a second distance from the base means, the second distance being greater than the first distance, whereby the body support means is positionable at more than one position relative to the shoulder support means. The apparatus may further include angle adjustment means for adjusting an angle of incline at which the container is supported. The apparatus may further include collapsing means for collapsing the apparatus into a collapsed configuration.

Other aspects and features of the present invention will become apparent to those of ordinary skill in the art upon considering the following description of embodiments of the invention in conjunction with the accompanying figures.

BRIEF DESCRIPTION OF THE DRAWINGS

In drawings which illustrate, by way of example only, embodiments of the invention.

DETAILED DESCRIPTION

An apparatus for supporting a container includes: base means; shoulder support means for supporting a shoulder of the container a first distance from said base means; and body support means for supporting a body of the container a second distance from said base means, said second distance being greater than said first distance, whereby said body support means is positionable at more than one position relative to said shoulder support means. The apparatus may include angle adjustment means for adjusting an angle of incline at which the container is supported. The apparatus may include collapsing means for collapsing the apparatus into a collapsed configuration.

Figure 1:
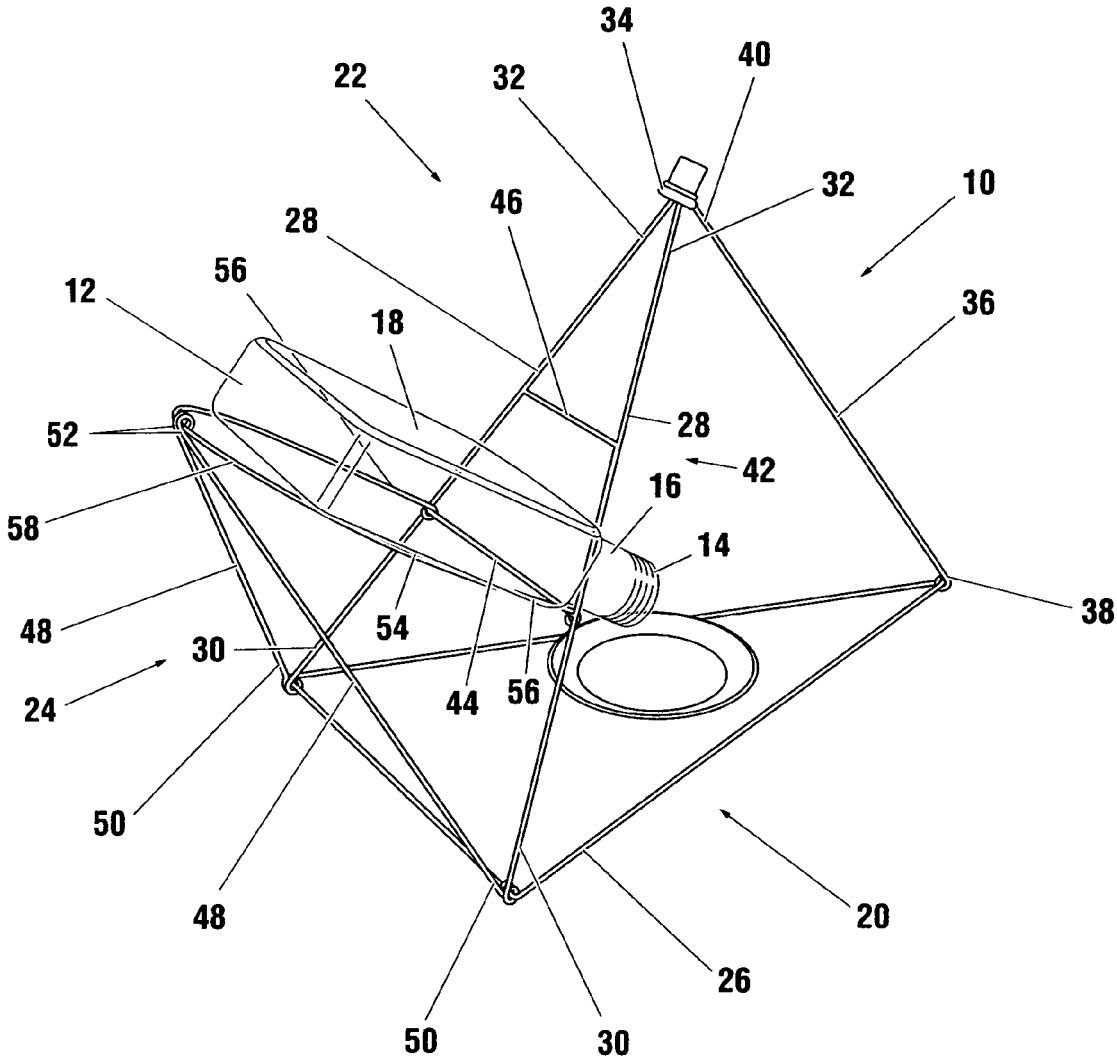
FIG. 1 is a perspective view of an apparatus for supporting a container according to a first embodiment of the invention.
Figure 2:
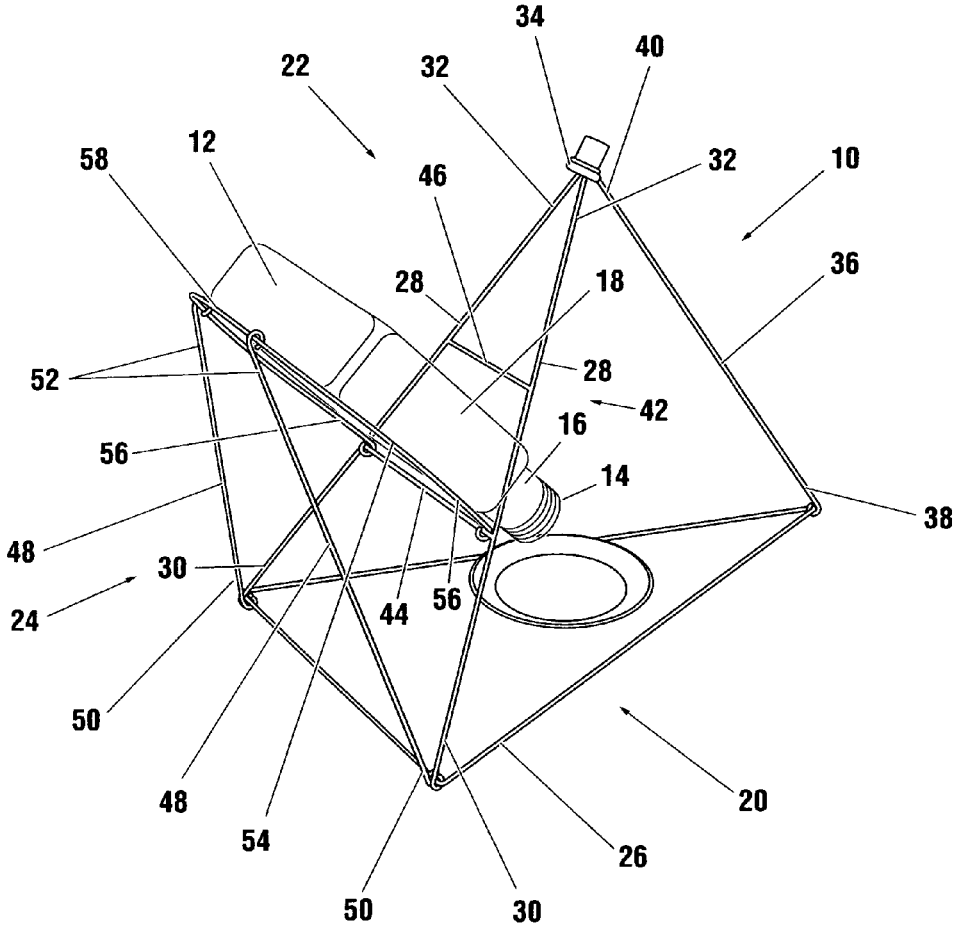
FIG. 2 is a perspective view of the apparatus shown in FIG. 1, showing an adjusted angle of incline.

Referring to FIGS. 1 and 2, the apparatus according to a first and preferred embodiment of the invention is shown generally at 10 in an operational configuration. The apparatus 10 serves to support a container 12 having a dispensing end 14 from which its contents can be drained, a shoulder 16, and a body 18 extending from the shoulder 16. The container 12 may have any shape and be of any size. The dispensing end 14, shoulder 16, and body 18 may all have identical, similar, analogous or differing shapes and cross-sectional areas, and may each have constant or varying shapes and cross-sectional areas. The dispensing end 14 may or may not be dimensioned for receiving a lid or cap, and may or may not be threaded. The shoulder 16 and the body 18 may be contiguously integrated or visually distinct, for example.

A dish or other open-topped container may be placed beneath the dispensing end 14 of the container 12 to catch contents being drained from the container 12 when supported by the apparatus 10, as shown in FIGS. 1 and 2.

The apparatus 10 includes a base such as the triangular base shown in FIGS. 1 and 2 generally at 20, a shoulder support such as the pyramid-shaped shoulder support shown generally at 22, and a body support such as the body support shown generally at 24. In FIGS. 1 and 2, the body support 24 is shown connected to the shoulder support 22. The shoulder support 22 and the body support 24 can have any shape and be of any size, provided the entire container 12 cannot pass the shoulder support 22 when the body support 24 is connected to the shoulder support 22 and the container 12 is placed on the apparatus 10 in the manner shown in FIGS. 1 and 2.

In the first embodiment shown in FIGS. 1 and 2, the base 20 preferably includes a frame 26 having a generally triangular outer perimeter. The frame 26 may be formed from stiff wire suitably shaped, including stiff wire joined at its ends to form a loop; removably connectable pieces suitably connected; lengths of rods joined at respective ends by welding, crimping, adhering, jam fitting and/or fastening by fastener; a unitary piece such as produced by molding, including injection molding, die casting, cutting, stamping, welding and/or punching metal, plastic, rubber, wood or other materials; and/or combinations thereof, for example. Additionally or alternatively, the base 20 may include a generally planar sheet, which may be made of any suitable material including plastic, metal, wood, rubber, ceramic, porcelain and/or combinations thereof, for example.

The shoulder support 22 preferably includes a pair of legs 28 attached to the base 20 at respective leg attachment ends 30 and joined together at respective opposite ends 32 to form a vertex. The attachment ends 30 are preferably spaced apart from each other and hinged such that the legs 28 are hingedly attached to the base 20. Hinged attachment ends 30 may be formed by loops through which a portion of the base 20 passes, as shown in FIGS. 1 and 2, or any other hinge technique provided the legs 28 are permitted to rotate about an axis defined by the linear distance between the attachment ends 30. The opposite ends 32 may be joined by welding, adhering, crimping, shaping, including twisting together, fastening, or combinations thereof, for example. The legs 28 may be formed by injection molding a plastic or other similar material to form a unitary piece intrinsically joined at the opposite ends 32. In the embodiment shown in FIG. 1, the shoulder support 22 includes a cap 34 placed at the joined ends 32. The cap 34 may be affixed to the joined ends 32, and if so may be affixed by any suitable method including welding, adhering, crimping, fastening, and/or combinations thereof, for example. The cap 34 is preferably an optional component not necessary for joining the opposite ends 32.

The shoulder support 22 also preferably includes a strut 36 attached to the base 20 at its attachment end 38. The strut 36 is shown in FIGS. 1 and 2 connected at its opposite strut end 40 to the pair of legs 28 at their joined ends 32. The strut 36 is preferably removably attachable to the pair of legs 28 at the joined ends 32. In the first embodiment shown in FIGS. 1 and 2, the strut 36 includes at its strut end 40 a loop and the cap 34 includes a lower portion of increased diameter relative to the upper portion of the cap 34. The loop at the strut end 40 is shown dimensioned to fit over upper the portion of the cap 34 but not over the lower portion thereof, such that the strut end 40 engages the cap 34, thereby maintaining the strut end 40 in place when the strut 36 is attached to the pair of legs 28.

The shoulder support 22 preferably includes a shoulder stop such as the crossbar shoulder stop 42 shown in FIGS. 1 and 2. The inclusion of the shoulder stop 42 advantageously permits the apparatus 10 to support a variety of different shaped and sized containers 12. The shoulder stop 42 can have any shape and be of any size, provided the container 12 cannot entirely pass through or along the shoulder stop 42 when the container 12 is placed on the apparatus 10 in the manner shown in FIGS. 1 and 2. Although not necessary, the shoulder stop 42 is preferably dimensioned such that the dispensing end 14 of the container 12 can pass through the shoulder stop 42, but that the shoulder 16 cannot.

The shoulder stop 42 preferably includes a crosspiece 44 extending transversely between the pair of legs 28. The crosspiece 44 can be in the shape of a bar, as shown in FIGS. 1 and 2, a rod, a plate, or other transversely extending piece. The longitudinal position of the crosspiece 44 along the inverted V-shape formed by the pair of legs 28 may be selected to optimally stop containers 12 of a desired shape and/or size. The shoulder stop 42 may also include a second crosspiece 46 extending transversely between the pair of legs 28 spaced apart from the crosspiece 44. The shapes of the crosspiece 44 and the second crosspiece 46 may be identical, similar, analogous or different. Preferably, the second crosspiece 46 is generally parallel to the crosspiece 44. The crosspieces 44 and 46 may be attached to the pair of legs 28 in any suitable manner, including welding, adhering, crimping, fastening, shaping, including wrapping respective ends of the crosspieces 44 and 46 around corresponding legs 28, and combinations thereof, for example.

Still referring to FIGS. 1 and 2, the body support 24 preferably includes a pair of arms 48 attached to the base 20 at respective arm attachment ends 50. At upper arm ends 52 opposite the arm attachment ends 50, the arms 48 are attached to a body support member, such as the U-shaped support member 54 shown in FIGS. 1 and 2, between support member ends 56 of the support member 54.

The arm attachment ends 50 are preferably hinged such that the arms 48 are hingedly attached to the base 20. Hinged arm attachment ends 50 may be formed by any hinge technique permitting the arms 48 to rotate about an axis defined between the arm attachment ends 50, including being formed by loops through which a portion of the base 20 may pass, and may be formed in a manner identical, similar, analogous or different, to that of the leg attachment ends 30. The arms 48 are preferably slidably attached at their upper arm ends 52 to the support member 54. The support member 54 is also preferably hingedly attached to the arms 48 such that the support member 54 can rotate about an axis defined between the upper arm ends 52. Slidable and hinging upper arm ends 52 may be formed by loops through which the support member 54 may pass, as shown in FIGS. 1 and 2, or any other suitable attachment technique, including using one or more fasteners, for example.

The support member ends 56 lie on either side of a central portion 58 of the support member 54. FIGS. 1 and 2 show the support member 54 connected at the support member ends to the shoulder support 22. In the first embodiment, the support member 54 is removably attachable to the shoulder support 22. Preferably, the support member 54 is removably attachable to the pair of legs 28 at or adjacent the shoulder stop 42. The support member ends 56 may be formed into hooks dimensioned to releasably receive the legs 28, for example. Additionally or alternatively, releasable fasteners may be affixed to the support member ends 56 for removably attaching the support member 54 to the shoulder support 22. The support member 54 may be of such shape and made of such material that the support member ends 56 are urged toward or away from each other when positioned to receive the legs 28. Such resilient effect associated with the support member 54 assists in maintaining the support member ends 56 in place when receiving the legs 28.

The materials of the shoulder support 22 components and the body support 24 components may be as described above in respect of the frame 26. The materials of the shoulder support 22 components, the body support 24 components and the frame 26 components may be identical, similar, analogous or different from each other.

Adjustability

Still referring to FIGS. 1 and 2, the angle of incline at which the container 12 is supported by the apparatus 10 is preferably adjustable. Adjusting the angle of incline may be accomplished in the first embodiment by moving the arms 48 away from or toward each other such that the upper arm ends 52 slide along the support member 54, which raises or lowers its central portion 58. Raising and lowering the central portion 58 changes the height at which the body support 24 supports the container 12 without changing the height at which the shoulder support 22 does so, thereby changing the angle of incline of the container 12. Slidably adjusting the upper arm ends 52 away from each other causes the central portion 58 to be raised. In an analogous manner, slidably adjusting the upper arm ends 52 toward each other causes the central portion 58 to be lowered. FIG. 1 shows the arms 48 some distance from each other so as to achieve a corresponding angle of incline. FIG. 2, in comparison, shows the arms 48 relatively distant from each other, with the effect of raising the central portion 58 and correspondingly increasing the angle of incline relative to the base 20 at which the container 12 is supported.

While FIGS. 1 and 2 show the body support 24 at two different positions relative to the shoulder support 22, the angle of incline is preferably continuously adjustable within a range of angles. Such range of angles permits the body support 24 to be positioned continuously at multiple positions relative to the shoulder support 22. In some embodiments, the body support 24 relative to the shoulder support 22 can be adjusted to discrete adjustment positions, thereby providing for discrete adjustment positions of the angle of incline.

Collapsibility

Figure 3:
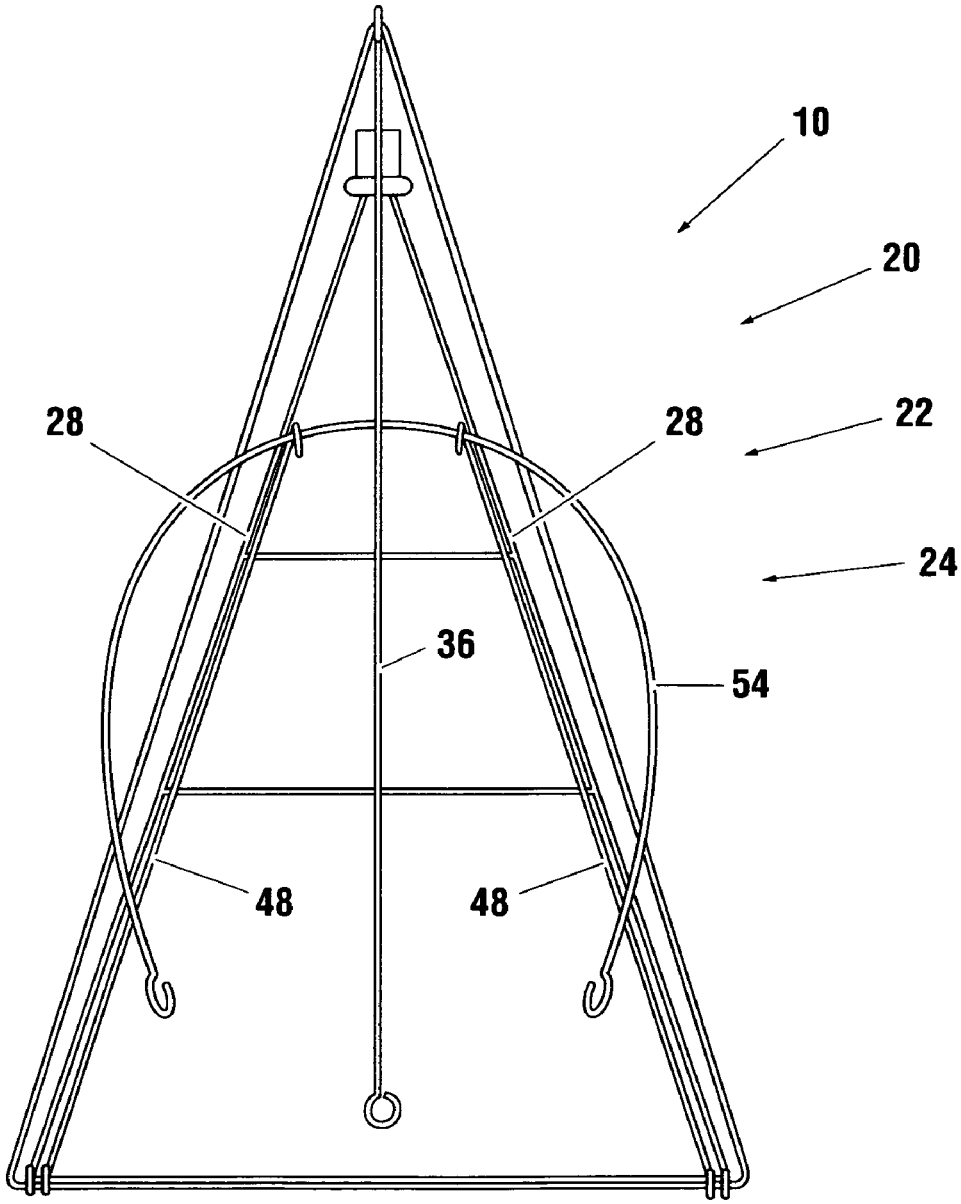
FIG. 3 is a top view of the apparatus shown in FIG. 1, showing the apparatus in a collapsed configuration.

Referring to FIG. 3, the apparatus 10 is shown in a collapsed configuration in which various components of the apparatus 10 are coplanar. The legs 28 and the strut 36 of the shoulder support 22 and the arms 48 and the support member 54 of the body support 24 are shown in FIG. 3 arranged to lay coplanar with the base 20. The collapsed configuration of the apparatus 10 advantageously reduces the storage space required to store the apparatus 10 when not in use. When the apparatus 10 is in the collapsed configuration, the body support 24 is at a collapsed position relative to the shoulder support 22. Such collapsed position differs from any adjustment positions possible when the apparatus 10 is in the operational configuration (FIGS. 1 and 2).

Figure 4:
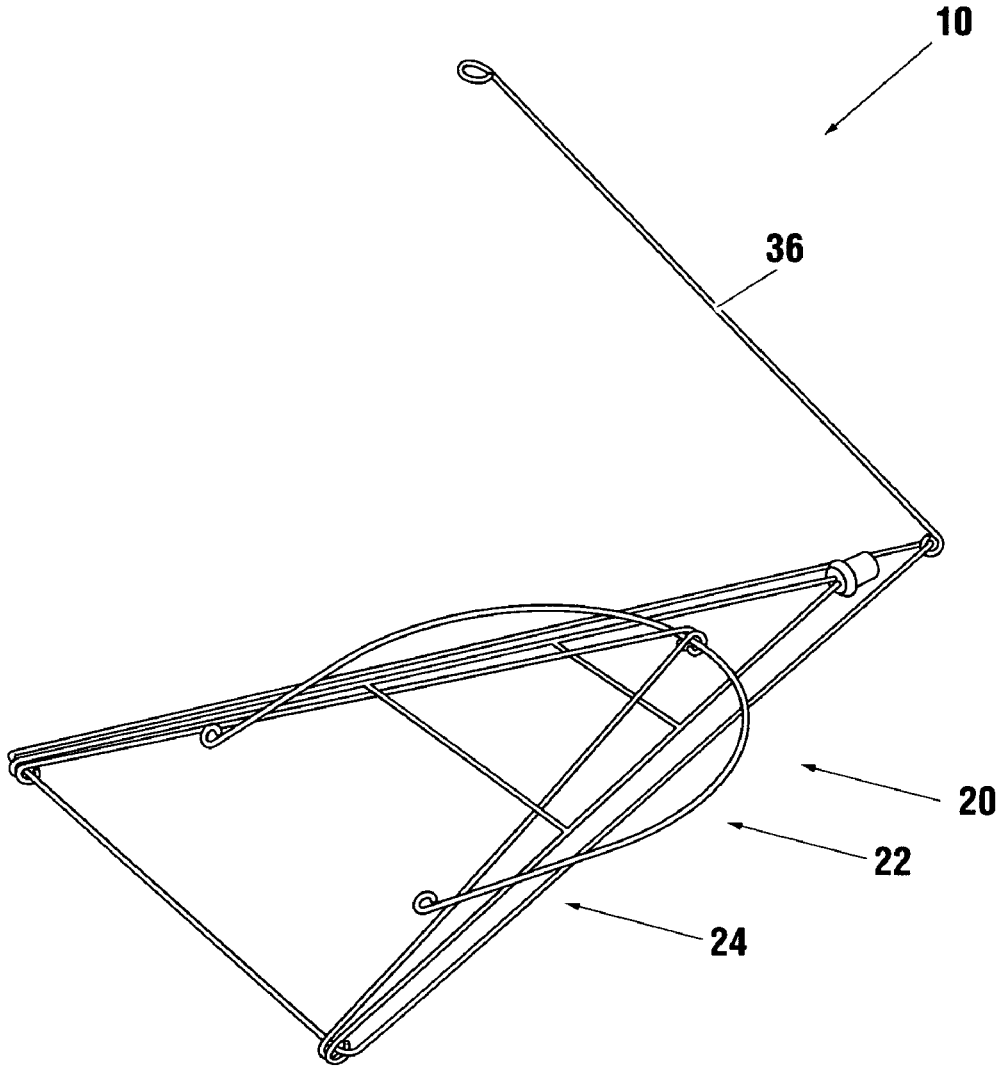
FIG. 4 is a perspective view of the apparatus shown in FIG. 1, showing a strut raised from its collapsed position.
Figure 5:
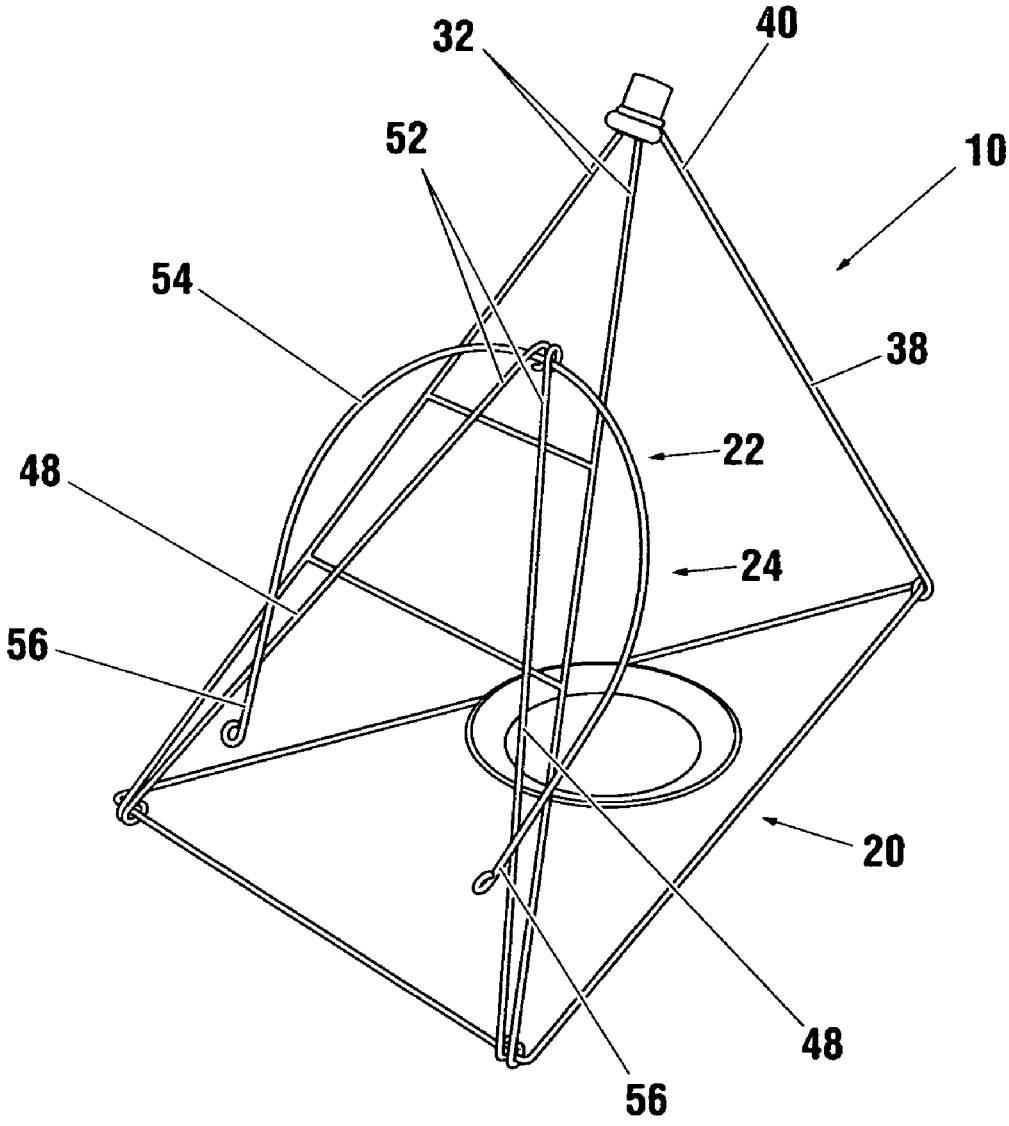
FIG. 5 is a perspective view of the apparatus shown in FIG. 1, showing a body support disconnected from a shoulder support.

Referring to FIGS. 4 and 5, a method of changing the relative positions of the body support 24 and the shoulder support 22 to move the apparatus 10 from the collapsed configuration to the operational configuration is provided. The strut 36 can be lifted up from its collapsed position to a raised position such as that shown in FIG. 4. With the strut 36 raised, the legs 28 can be lifted up to a raised position as shown in FIG. 5. Lifting the legs 28 also raises the arms 48 and the support member 54 when such components were previously laying on top of the legs 28.

With the legs 28 and the strut 36 raised, the strut end 40 can be engaged with the joined ends 32 of the legs 28 (FIG. 5). With the shoulder support 24 operably placed, the support member ends 56 can be engaged with the shoulder support 24 by rotating the support member 54 relative to the arms 48 and attaching the support member 54 to the shoulder support 24. In such engaged position, the support member 54 extends between the shoulder support 24 and the upper arm ends 52 to place the body support 24 in an operable configuration. Moving the body support 24 from its collapsed to its operable configuration typically involves hingedly rotating the arms 48 relative to the base 20. The distance separating the two arms 48 may then be adjusted to achieve a desired height for the body support 24, as illustrated in FIGS. 1 and 2 for example. The apparatus 10 is thusly placed in the operational configuration in which a container may be supported by the apparatus in the manner described above.

The apparatus 10 in the operational configuration may be collapsed into the collapsed configuration by performing the above-described steps in the reverse order. By way of example, the body support 24 is disconnected from the shoulder support 22, the strut 36 is disconnected from the legs 28, and the legs 28, arms 48, support member 54 and strut 36 are arranged substantially coplanar to the base 20.

Variations of the above-described steps for moving the apparatus 10 between the collapsed and operational configurations are possible. For example, the order in which the different components can be layered in the collapsed configuration may vary, thus varying the most suitable order in which the components are raised to place the apparatus 10 in the operational configuration.

Thus, there is provided an apparatus for supporting a container, the apparatus comprising: a base; a shoulder support attached to the base for supporting a shoulder of the container a first distance from the base; and a body support attached to the base for supporting a body of the container a second distance from the base greater than the first distance, whereby the body support is positionable at more than one position relative to the shoulder support. The apparatus may be collapsible to a generally planar collapsed configuration. The apparatus may be operable to support the container at an adjustable angle of incline.

While specific embodiments of the invention have been described and illustrated, such embodiments should be considered illustrative of the invention only. The invention may include variants not described or illustrated herein in detail. For example, the relative dimensions of the various components of the apparatus may be varied, including dimensioning the legs such that, in the collapsed configuration, the joined ends extend past the base and the strut lies between the legs. Thus, the embodiments described and illustrated herein should not be considered to limit the invention defined solely in accordance with the accompanying claims.

LIST OF REFERENCE CHARACTERS apparatus 10
container 12
dispensing end 14
shoulder 16
body 18
base 20
shoulder support 22
body support 24
frame 26
legs 28
leg attachment ends 30
ends 32 (joined)
cap 34
strut 36
attachment end 38 (strut)
strut end 40
shoulder stop 42
crosspiece 44
second cross-piece 46
arms 48
arm attachment ends 50
upper arm ends 52
support member 54
support member ends 56
central portion 58

What is claimed is:

1. An apparatus for supporting a container, the apparatus comprising:

(a) a base;

(b) a shoulder support attached to said base for supporting a shoulder of the container a first distance from said base, wherein said shoulder support comprises first and second legs attached to said base at respective and spaced apart first and second leg attachment ends of said first and second legs, and wherein said shoulder support comprises a shoulder stop dimensioned to prevent said body from passing said shoulder stop; and (c) a body support attached to said base for supporting a body of the container a second distance from said base greater than said first distance, whereby said body support is positionable at more than one position relative to said shoulder support; and wherein said shoulder stop comprises first and second spaced apart and generally parallel crosspieces extending between said first and second legs, respectively.

2. The apparatus of claim 1, wherein said first and second legs are joined at joined ends opposite said first and second leg attachment ends.

3. The apparatus of claim 2, wherein said first and second legs are hingedly attached at said first and second leg attachment ends to said base and wherein said shoulder support comprises a strut hingedly attached to said base at a strut attachment end of said strut, said strut being removably attachable at an opposite strut end to said first and second legs at said joined ends, the apparatus being configurable in an operational configuration, in which said strut is attached to said first and second legs, and in a collapsed configuration, in which said strut, said first and second legs and said base are substantially coplanar.

4. An apparatus for supporting a container, the apparatus comprising:

(a) a base;

(b) a shoulder support attached to said base for supporting a shoulder of the container a first distance from said base; and (c) a body support attached to said base for supporting a body of the container a second distance from said base greater than said first distance, whereby said body support is positionable at more than one position relative to said shoulder support;

wherein said body support comprises first and second arms attached to said base at respective and spaced apart first and second arm attachment ends, and a body support member removably attachable at support member ends of said body support member to said shoulder support, said first and second arms being slidably attached at respective sliding ends opposite said first and second arm attachment ends to said body support member between said support member ends; and wherein said body support member is rotatably attached to said first and second arms and wherein said first and second arms are hingedly attached to said base, the apparatus being configurable in an operational configuration, in which said body support member is attached to said shoulder support, and a collapsed configuration, in which said body support member, said first and second arms and said base are substantially coplanar.

5. The apparatus of claim 3, wherein said body support comprises first and second arms attached to said base at respective and spaced apart first arm attachment ends, and a body support member removably attachable at support member ends of said body support member to said shoulder support, said first and second arms being slidably attached at respective sliding ends opposite said first and second arm attachment ends to said body support member between said support member ends.

6. The apparatus of claim 5, wherein said body support member is rotatably attached to said first and second arms and wherein said first and second arms are hingedly attached to said base, said body support member being attached to said shoulder support when the apparatus is in said operational configuration, and said body support member, said first and second arms and said base being substantially coplanar when the apparatus is in said collapsed configuration.

* * * * *